United States Patent [19]

Tsubai et al.

[11] Patent Number: 4,632,896

[45] Date of Patent: Dec. 30, 1986

[54] PROCESSING SOLUTION FOR SILVER COMPLEX DIFFUSION TRANSFER PROCESS COMPRISING AMINO ALCOHOLS

[75] Inventors: Yasuo Tsubai; Koji Okazaki, both of Nagaokakyo, Japan

[73] Assignee: Mitsubishi Paper Mills, Ltd., Tokyo, Japan

[21] Appl. No.: 774,521

[22] Filed: Sep. 10, 1985

[30] Foreign Application Priority Data

| | | | |
|---|---|---|---|
| Sep. 20, 1984 | [JP] | Japan | 59-197820 |
| Sep. 20, 1984 | [JP] | Japan | 59-197821 |
| Sep. 20, 1984 | [JP] | Japan | 59-197823 |
| Sep. 20, 1984 | [JP] | Japan | 59-197824 |
| Oct. 25, 1984 | [JP] | Japan | 59-225270 |
| Jan. 23, 1985 | [JP] | Japan | 60-11704 |
| Jan. 23, 1985 | [JP] | Japan | 60-11705 |

[51] Int. Cl.[4] ..... G03C 5/54; G03C 5/30; G03C 5/38

[52] U.S. Cl. ..... 430/249; 430/244; 430/251; 430/398; 430/399; 430/449; 430/455; 430/456; 430/485; 430/487

[58] Field of Search ..... 430/244, 249, 251, 398, 430/399, 456, 487, 490, 492, 449, 464, 455, 485

[56] References Cited

U.S. PATENT DOCUMENTS

| | | | |
|---|---|---|---|
| 3,619,185 | 11/1971 | Kasman | 430/456 |
| 4,147,543 | 4/1979 | Kuboteta et al. | 430/456 |
| 4,298,673 | 11/1981 | Kuboteta et al. | 430/456 |
| 4,310,613 | 1/1982 | Iguchi et al. | 430/251 |
| 4,362,811 | 12/1982 | Iguchi et al. | 430/487 |
| 4,568,634 | 2/1986 | Hayashi | 430/487 |

*Primary Examiner*—Richard L. Shilling

*Attorney, Agent, or Firm*—Cushman, Darby & Cushman

[57] ABSTRACT

There is disclosed a processing solution for silver complex diffusion transfer process which contains at least one amino alcohol having a pKa value of less than 9 and at least one amino alcohol having a pKa value of 9 or more which are measured in a 50 wt % aqueous ethanol solution at 25° C.

23 Claims, No Drawings

PROCESSING SOLUTION FOR SILVER COMPLEX DIFFUSION TRANSFER PROCESS COMPRISING AMINO ALCOHOLS

BACKGROUND OF THE INVENTION

This invention relates to a processing solution for the silver complex diffusion transfer process and a processing method by using said solution.

The principle of the silver complex diffusion transfer process (hereinafter referred to as DTR process) is well known from the description in U.S. Pat. No. 2,352,014 and many other patents and literature. In DTR process, the silver complex is imagewise transferred by diffusion from a silver halide emulsion layer to an image receptive layer and transformed therein into a silver image generally in the presence of physical development nuclei. For this purpose, the imagewise exposed silver halide emulsion layer is arranged so as to be in contact with or is brought into contact with the image receptive layer in the presence of a developing agent and a solvent for the silver halide, thereby to convert the unexposed silver halide into a soluble silver complex. In the exposed areas of the silver halide emulsion layer, the silver halide is developed into silver which is insoluble and, hence, cannot diffuse. In the unexposed areas of the silver halide emulsion layer, the silver halide is converted into a soluble silver complex and is transferred to an image receptive layer wherein the silver complex formes a silver image generally in the presence of development nuclei.

The DTR process can be utilized in a wide field such as reproduction of documents, making of printing plates, preparation of block copies, and instant photography.

Particularly in reproducing documents or preparing block copies, a negative material having a silver halide emulsion layer is brought into close contact with a positive material having an image receptive layer in a DTR processing solution generally containing a silver-complexing agent, thereby to form a silver image receptive layer of the positive material. The silver mage in these cases is required to be pure black or bluish black in color and sufficiently high in density. It is also important that the silver image be high in contrast and sharpness, excellent in image reproducibility, and preferably high in transfer speed. In addition, these properties of the positive material should not be greatly dependent upon the processing conditions such as, for example, processing time and temperature.

It is easily presumable from the principle of DTR process that the process of image formation is greatly affected by the processing conditions, especially temperature and speed of processing, and this fact is well known to the art.

As examples of general characteristics of the formed image affected by the environmental processing conditions, particularly processing temperature and conditions of conveyance in DTR process, there may be mentioned the following:

1. Change in sensitivity, general tone, color tone, and density (both reflection and transmission densities).

2. Increased tendency of staining (due to formation of fine grains of silver colloid) on the image receptive sheet.

3. Decreased ability of forming minute images such as fine lines or fine dots with the increase in processing temperature or the decrease in rate of conveyance.

Although a large number of processing solutions have been proposed to solve the above problems, as disclosed in, for example, Japanese Patent Application "Kokai" (Laid-open) Nos. 93, 338/73, 79, 445/80, 157, 738/80, 176, 036/82, and 72, 143/83, yet none of these provides a means to solve collectively the above problems. In the background of the circumstances, there seems to be a general belief such that the DTR process is difficult to control, because the process is based on a delicate balance among chemical development, dissolution, diffusion, and physical development.

Moreover, on continual and long-term use of the processing solution (hereinafter referred to as running processing), the above change of characteristics become pronounced and other changes will take place.

The image formation system for the DTR process generally employs a simplified line of apparatuses. For instance, a processor is composed of a tray to hold a transfer developer, a pair of squeeze rollers to bring a negative sheet and a positive sheet into close contact, and a motor to drive the rollers. In such a system, even when no material is processed, a conventional running solution will retain its processing characteristics only for several days; and when photographic materials are continually processed, the running solution will become exhausted in a shorter period of time.

SUMMARY OF THE INVENTION

An object of this invention is to provide a processing solution for use in the silver complex diffusion transfer process, which is affected very little by the change in processing conditions, is able to impart satisfactory photographic characteristics to the processed material, and is improved in performance characteristics required for use in running processing.

Another object of this invention is to provide a method of long-lasting processing by use of said processing solution.

Other objects and advantages of this invention will become apparent from the description which follows.

The objects of this invention were found to be fundamentally achieved by a processing solution for the DTR process, which is characterized by containing at least one amino alcohol having a pKa value of below 9 and at least one amino alcohol having a pKa value of 9 or above, said pKa values being as determined in a 50% (by weight) aqueous ethanol solution at 25° C.

DETAILED DESCRIPTION OF THE INVENTION

The invention is described in further detail hereunder.

The addition of an amino alcohol to the DTR processing solution is well known as described in the aforementioned and other patent literature. The amino alcohol is known to have advantages of improving the contrast and increasing the capacity of processing solution. However, as a result of tests on a large number of amino alcohols carried out in consideration of the present objects, the present inventor confirmed that when used singly, none of the amino alcohols is able to achieve the objects. Upon continued extensive study, it has been found that it is possible to obtain a processing solution having characteristics markedly improved for use in running processing and which are less affected by the change in processing conditions, imparting desirable photographic characteristics to the processed material, by the use of a combination of two amino alcohols in different pKa ranges, the border line between both ranges being at a specified pKa value (logarithm of the reciprocal of an acid dissociation constant).

The pKa values of amino alcohols are described, for example, in "Stability Constants of Metal-Ion Complexes" (Special Publication No. 17, 1964 and No. 25, 1971, published by The Chemical Society, London) or in "Fundamentals II, Chemical Handbook" (revised 3rd Ed., June 25, 1985, published by Maruzen Co., Tokyo) and are also easily determinable. The pKa value, as used herein, is defined as a value determined in an ethanol-water (50:50) mixture at 25° C. In this invention, the pKa value is sometimes expressed in terms of pKa [aq.] which is a value determined in aqueous solution of amino alcohol. The value of pKa [aq.] is generally higher (by about 0.2) than the pKa value determined in said aqueous ethanol. Examples of the interrelation are as shown in the following table.

| | pKa | pKa [aq.] |
|---|---|---|
| Ethanolamine | 9.34 | 9.51 |
| Diethanolamine | 8.73 | 8.90 |
| Triethanolamine | 7.40 | 7.76 |
| 2-Amino-2-(hydroxymethyl)propane-1,3-diol | 7.81 | 8.06 |

The pKa [aq.] value of an amino alcohol is generally still higher in an actual processing solution containing various ingredients. Although not found by the presumption, the present invention will become more easily understandable by the following theoretical consideration. As examples of factors affecting the characteristics of a DTR processing solution which is continually used in running operation, there may be mentioned a decrease in the constituents content caused by the consumption by sheet materials, a change in composition, a decrease in pH value, concentration of the processing solution due to evaporation of water (and volatile constituents), a decrease in pH value caused by the absorption of atmospheric carbon dioxide, and oxidation of developing agents. At first the present inventors ascertained a large effect of absorbed carbon dioxide and attempted to solve this problem. As a result, it was found that when use is made of a mixture of at least one amino alcohol having a pKa value (as defined above) below 9 and at least one amino alcohol having a pKa value of 9 or above, it is possible to obtain a processing solution having steadier and better characteristics which are less affected by processing conditions for a long period of time beginning immediately after preparation of the solution and throughout a long-term running processing, as compared with a conventional processing solution. It was experimentally confirmed that in a processing solution containing absorbed carbon dioxide, an amino alcohol having a pKa value below 9 and an amino alcohol having a pKa value of 9 or above exhibit a lower pKa value and a higher pKa value, respectively, as compared with the pKa value of carbonic acid ($H_2CO_3$). As a consequence, the processing solution containing absorbed carbon dioxide retains its development ability by the presence of an amino alcohol having a pKa value below 9. Although an amino alcohol having a pKa value below 9 improves markedly the ability of processing solution in running processing as is apparent from the above description, yet such an amino alcohol is unsatisfactory in improving the photographic characteristics when the processing temperature is low and, in addition, it has another disadvantage of causing the staining of an image receptive sheet in running processing. It was found that these disadvantages can be eliminated by the presence of an amino alcohol having a pKa value of 9 or above. The above discoveries have led to the accomplishment of this invention.

The amino alchols used in this invention is a primary, secondary, or tertiary amine compound having at least one hydroxyalkyl group, particularly preferred being secondary and tertiary amines. The amino alcohols include compounds represented by the general formula

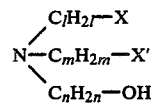

(A)

wherein X and X' each represents a hydrogen atom, a hydroxyl group, or an amino group, l and m each represents 0 or an integer of 1 or above, and n represents an integer of 1 or above. As particular compounds, mention may be made of ethanolamine, diethanolamine, triethanolamine, diisopropanolamine, N-methylethanolamine, N-aminoethylethanolamine, N,N-diethylethanolamine, N,N-dimethylethanolamine, N-methyldiethanolamine, N-ethyldiethanolamine, 3-aminopropanol, 1-aminopropan-2-ol, 4-aminobutanol, 5-aminopentan-1-01, 3,3'-iminodipropanol, and N-ethyl-2,2'-iminodiethanol. Aforementioned 2-amino-2-(hydroxymethyl)-propane-1,3-diol and 2-amino-2-methylpropane-1,3-diol may also be used.

Generally speaking, the pKa value as defined above is 9 or above for the amino alcohols having one hydroxyalkyl group and below 9 for the amino alcohols having 2 or more hydroxyalkyl groups. The difference in pKa value between amino alcohols to be combined is 0.3 or more, preferably 0.5 or above. The total amount of amino alcohols in one liter of processing solution is in the range of from 0.25 to 2, preferably from 0.4 to 1.5, moles. The molar ratio of an amino alcohol having a pKa value below 9 to that having a pKa value of 9 or above is in the range of from 2:8 to 8:2.

The DTR processing solution according to this invention contains alkaline substances, e.g. sodium hydroxide, potassium hydroxide, lithium hydroxide, sodium carbonate, and trisodium phosphate; preservatives, e.g. sodium sulfite, potassium sulfite, and other sulfites; thickeners, e.g. carboxymethylcellulose and hydroxyethylcellulose; antifoggants, e.g. potassium bromide, potassium iodide, and benzotriazole; silver halide solvents, e.g. sodium thiosulfate, potassium thiocyanate, and cyclic imides; coloring agents, e.g. 1-phenyl-5-mercaptotetrazole; development modulators, e.g. polyoxyalkylene compounds, and quaternary ammonium salts; development nuclei, e.g. those described in Brit. Patent No. 1,001,558; and, if necessary, developing agents, e.g. hydroquinone and 1-phenyl-3-pyrazolidone.

The pH of the processing solution should be that which activates the developing agent and is generally about 10 to 14, preferably about 11 to 14. The optimum pH in particular case depends on the type of photographic element, intended image, types and amounts of various compounds used in the processing liquid composition, and processing conditions.

Owing to the presence of a combination of amino alcohols having different pKa values, even when the pH of the processing solution decreased down to 10 or below, after some time of running processing, from the initially adjusted pH of 11 to 14, the present processing solution retains the initial photographic characteristics, indicating steady processing ability. The processing conditions such as temperature and time for the present processing solution may vary, without any restriction, according to the constituents of photographic elements and the composition of processing solution. Being little affected by the processing conditions, the present processing solution exhibits steady processing ability.

In carrying out the DTR process, as described, for example, in Brit. Patents Nos. 1,000,115, 1,012,476, and 1,093,177, it is a common way to incorporate a developing agent into a photosensitive silver halide emulsion layer and/or an image receptive layer, or another water-permeable layer contiguous to the emulsion layer or image receptive layer. As a consequence, the processing solution for use in the development can be so-called alkaline activator solution containing substantially no developing agent. The processing solution of this invention can be such an alkaline activator solution.

Since the alkaline activator solution according to this invention is hardly affected by atmospheric carbon dioxide, it is possible to leave out conventionally employed $M_3PO_4$ (M is an alkali metal such as sodium or potassium) from the constituents or reduce the $M_3PO_4$ content to 0.1 mole/liter or below, resulting in marked improvement in processing characteristics. As described in aforementioned and other patents, it is well known to use trisodium phosphate ($Na_3PO_4$) as an alkali reagent in a concentration of 0.15 to 0.25 mole/liter in the alkaline activator solution. The present inventor found that the present processing solution containing a specified combination of amino alcohols can be further improved in the processing ability by reducing the trisodium phosphate content as far as possible, preferably to substantially zero. The resulting processing solution is markedly improved in running processing ability and in photographic characteristics which are practically unaffected by the change in processing conditions. It seems that with continued running processing, there occur simultaneously a decrease of pH due to absorption of carbon dioxide and an increase in concentration of the solution due to evaporation of water, both of which cooperate with sodium phosphate in suppressing the absorption of processing solution by negative and positive p.hotographic materials, resulting in a decrease in the ability of processing solution to activate the development.

Furthermore, the advantage of this invention is enhanced by the discovery that the amino alcohol serves also as a swelling agent for the gelatin layer by interfering with antiswelling effect of an inorganic salt, particularly sodium phosphate. This can be deduced from the fact that if the running processing is carried out by using a processing solution containing no amino alcohol, the concentration of inorganic salts becomes higher owing to the evaporation of water from the processing solution and a pair of negative and positive materials developed in such a solution become more difficult to separate from each other, as compared with the case where both materials are developed in a fresh solution; whereas such separation becomes easier when developed in a processing solution containing an amino alcohol, especially that having a pKa below 9. From this, it will be understandable that the processing solution may contain sodium phosphate, provided that the sodium phosphate content is less than that conventionally used. The running solution may contain about half or less of conventionally used amount (75 g/liter or about 0.2 mole/liter), that is, 0.1 mole/liter or less, preferably 0.07 to 0.0 mole/liter, of $Na_3PO_4$, $12H_2O$. The alkali reagent used in the activator solution can be sodium hydroxide or potassium hydroxide.

Even when the present processing solution contains a silver halide developing agent, the inorganic alkali (sodium hydroxide or potassium hydroxide) content should be zero or about 0.2 mole/liter or less. The amino alcohol is known to serve as preservative, being able to keep the silver halide developing agent from oxidation [Japanese Patent Application "Kokai" (Laid-open) No. 93,338/73].

Since the amino alcohol acts also as an alkali reagent, it follows that if used in combination with an inorganic alkali reagent, the total alkali becomes excessive, resulting in deterioration of photographic density and running processing ability of the processing solution. As a result of continued study, it was found that the above difficulties can be largely removed by decreasing the inorganic alkali content to zero or a least possible quantity and, at the same time, jointly using another amino alcohol of a different pKa value.

Although capable of markedly improving the running processing characteristics, the amino alcohol of a pKa value below 9 has disadvantages of rendering the photographic characteristics insufficient at low processing temperatures and having a tendency to cause staining of the image receptive sheet. Such difficulties can be overcome by the joint use of another amino alcohol having a pKa value of 9 or above and, in addition, by the reduction of inorganic alkali content to 0.2 mole or below, preferably 0.15 to 0 mole, per liter of the processing solution, while antioxidation activity of the amino alcohol being, of course, retained.

The silver halide developing agent used in this invention is preferably a p-dihydroxybenzene compound such as, for example, hydroquinone, methylhydroquinone, chlorohydroquinone, or the like in an amount of 0.07 to 0.2 mole per liter of the processing solution. It is most preferable to include, in addition to the p-dihydroxybenzene compound, 1-phenyl-3-pyrazolidone or a derivative thereof in an amount of preferably $2\times10^{-3}$ to $2\times10^{-2}$ mole per liter of the processing solution. The pyrazolidone compound can be included in negative or/and positive materials.

The present processing solution essentially comprises a combination of an amino alcohol of a pKa value below 9 and an amino alcohol of a pKa value of 9 or above. Typical examples of the compositions are as shown in the following table.

| | mole/liter | |
|---|---|---|
| | Alkaline activator solution | Processing solution containing developing agent |
| $M_3PO_4$ | 0–0.1 | — |
| MOH | 0–0.2 | |
| Sulfite | 0.3–0.7 | |
| Thiosulfate | 0.02–0.15 | |

-continued

| | mole/liter | |
|---|---|---|
| | Alkaline activator solution | Processing solution containing developing agent |
| Hydroquinone | — | 0.07–0.2 |
| 1-Phenyl-3-pyrazolidone | — | $2 \times 10^{-3}$–$2 \times 10^{-2}$ |
| Amino alcohol (pKa ≧ 9) | | 0.1–1.2 |
| Amino alcohol (pKa < 9) | | 0.1–1.2 |
| Other additives | | |

Note:
M represents an alkali metal.
Other additives include toning agents, antifoggants, thickeners, etc.

The thickener is added in an amount sufficient for increasing the viscosity of processing solution to 3 to 20 cps (at 20° C). Such an amount of the thickener is especially effective for the running processing using an undermentioned replenisher.

Up to the present, in the running processing in a processor with about one liter of a processing solution, both the quantity of sheet material which can be processed (processing capacity) and the life of processing solution (processable time span) have limits. The life of fresh processing solution which is left standing without processing the sheet material is several days at most. If the exhausted processing solution is to be used in processing, the solution must be replaced by a fresh solution or replenished with a fresh concentrated solution. If a conventional processing solution is used in running processing while being replenished, the life cannot be extended to an expected period of time and, in most cases, must be replaced by a fresh solution. On the contrary, since the processing solution of this invention has a larger processing capacity, the life of running solution can be extended to longer period of time by using the undermentioned replenisher, as compared with a conventional processing solution.

A typical example of the replenisher according to this invention is an aqueous solution containing at least an amino alcohol of a pKa value of 9 or above which is consumed in the processing solution by absorption of carbon dioxide or other reasons and a preferable replenisher has substantially the same composition as that of fresh processing solution. Another example of the replenisher is an aqueous solution suitable for diluting the processing solution containing concentrated inorganic salts owing to the evaporation of water; a preferable replenisher is an aqueous alkaline solution prepared by diluting a fresh processing solution with water. A still another example is substantially water. The running processing with suitable dilution according to this invention seems to be reasonable from the following assumption.

A conventional so-called alkaline activator solution, which contains no developing agent, commonly used in DTR processing contains comparatively large amounts of inorganic salts such as sulfite, thiosulfate, and sodium phosphate ($Na_3PO_4$). Although playing an important role in DTR development, these salts interfere with the swelling of gelatin layers of negative and/or positive materials and, hence, decrease the absorption of processing solution. Accordingly, the concentration of inorganic salts becomes higher corresponding to the evaporated water during the running processing, resulting in inhibition of the development. On the other hand, the processing solution, which absorbed atmospheric carbon dioxide during the running processing becomes decreased in pH and increased gradually in carbonate content, thus contributing also to the increase in concentration of inorganic salts. Moreover, owing to the consumption by running processing, the processing solution undergoes variation in concentration of each ingredient, resulting in imbalance of proportions. Among the variations caused by the running processing, the increased inorganic salt concentration due to evaporation of water can be restored to the initial value, i.e. the concentration of fresh solution, by replenishing with a quantity of water corresponding to that lost by evaporation. However, the control of salt concentration is difficult, because in the running processing a portion of the processing solution is carried away by the nagative and positive materials, making obscure the total amount of lost water. As a consequence, the processing solution is subject to fluctuation in salt concentration. It was found by the present inventors that in the running processing with a processing solution containing amino alcohols while replenishing with water, the above-noted difficulties are almost overcome and the initial photographic characteristics are retained for a long period of time, e.g. one month or more. Although the reason for this is yet to be elucidated, a presumption is described hereunder.

Amino alcohols are known to act as an alkali reagent, as a solvent for silver halides, and as a preservative. The present inventor found that amino alcohols act as a swelling agent for a gelatin layer by inhibiting the anti-swelling action of inorganic salts. This is understandable from the fact such that in running processing with a processing solution containing no amino alcohol, the inorganic salt content becomes higher owing to the evaporation of water and a pair of negative and positive materials after development becomes more difficultly separable as compared with the case of fresh processing solution, whereas such a difficulty encountered in separating both materials from each other is markedly alleviated. Accordingly, amino alcohols exert a counter effect on inorganic salts present in comparatively high concentration in fresh processing solution and those present in higher concentration in running processing solution in operation, said inorganic salts in both cases having antiswelling effect on the gelatin layer. When the processing solution containing inorganic salts in a concentration beyond a marginal concentration (which varies depending on the types and amounts of salts and amino alcohol) is insufficiently diluted (the concentration of inorganic salts is higher than that in the initial solution), amino alcohols act in the same manner as described above. It seems that when the processing solution in operation is excessively diluted or undergoes a decrease in pH or a change in composition by the running processing, the properties of amino alcohols as an alkali reagent, as a solvent for silver halides, and as a preservative are manifested auxiliarily (or primarily in some cases) so as to render the effects negligible. According to this invention the processing solution withstands continued running processing over a very long period of time, because the running processing solution is diluted with an aqueous solution containing at least one of the effective ingredients in a concentration lower than that in fresh solution.

In an example of preferred embodiments of this invention, there is shown a processing procedure in which the concentrated inorganic salts in a running processing solution are diluted with a replenisher prepared by diluting the fresh processing solution (initial solution) with water. However, it is not necessary to use a diluted initial solution; it is possible to use an aqueous solution containing effective ingredients in a concentration lower than that in the initial solution. The effective ingredients are those which play important roles in forming a silver image, such as, for example, amino alcohol, inorganic alkali reagent, solvent for silver halides (e.g. thiosulfate), developing agent (e.g. hydroquinone), or preservative (e.g. sulfite), which are reduced in concentration by consumption, oxidation, evaporation, or decomposition during the running processing and, if not replenished, become insufficient for exhibiting full effect. The processing solution, which has become exhausted and concentrated by consumption of the solution and evaporation of water, is replenished with an aqueous solution containing the effective ingredients which has become deficient so that the initial performance characteristics may be substantially restored.

Owing to the desirable effect of amino alcohols upon the variable factors of the running processing, the processing solution of this invention has an advantage such that even if there is some excess or deficiency of water and effective ingredients in the replenisher, the performance characteristics remain substantially unchanged from those of the fresh processing solution and, as a consequence, the running processing can be continued without interruption for a markedly extended period of time.

The amount of processing solution carried away by negative and positive materials can be roughly predicted and the amount of evaporated water is known from the amount of residual processing solution which has been concentrated by the running processing. From these data, the dilution ratio in preparing the replenisher from the fresh processing solution is found by simple calculation. For instance, when the amount of processing solution which was carried away is A and the amount of evaporated water is B, the replenisher is prepared from the fresh solution by $((A+B)/A)$−fold dilution with water. The dilution of the running solution with the replenisher can be performed at any time during the running processing. Although depending upon the type and content of the inorganic salts, it is generally performed when about 10% or more of water has been evaporated and the replenishment is repeated regularly during the running processing. It is possible to add the replenisher periodically or automatically from a replenisher tank conveniently attached to the processor. With the increase in inorganic salt content of the fresh processing solution, the dilution with a replenisher is required to perform at earlier stage of running processing and more frequently. Therefore, the inorganic salt content of the fresh solution should be low as far as possible, even when replenishment is performed without dilution.

The alkaline activator solution and the replenisher which meet the following requirements (a), (b), and (c) gurantee the running processing for much extended period of time whether dilution is employed or not.

(a) 0–0.13 mole/liter $M_3PO_4$ (M is an alkali metal),
(b) 0.5 mole/liter or more of amino alcohol, and
(c) An amount of a water-soluble polymer necessary to bring the viscosity of processing solution to 3 to 20 centipoises.

The amino alcohol (b) used at least in the processing solution is a pair of amino alcohols having different pKa values as described above.

The function of a water-soluble polymer in the processing solution seems to be as described below.

An alkaline activator solution contains inorganic salts such as sulfite and thiosulfate besides sodium phosphate, which have antiswelling effect on a gelatin. As a consequence, it is difficult to prevent the concentration of inorganic salts from becoming higher in a long-term running processing, resulting in suppression of the swelling of gelatin, even if sodium phosphate is absent or is reduced in amount. In an activator solution thickened by the presence of a water-soluble polymer, when a negative material and a positive material are brought into close contact, the thickened solution is held between them, resulting in satisfactory transfer development even if the swelling of gelatin layers is suppressed to a certain degree. If a water-soluble polymer is used in a conventional alkaline activator solution containing sodium phosphate, coagulation of the polymer takes place during the running processing owing to the presence of a large amount of sodium phosphate. In the processing solution of this invention, such a phenomenon will not take place and, hence, a long-term running processing becomes possible.

The negative material generally used in DTR process comprises at least one silver halide emulsion layer coated on a support at a coverage of 0.5–3.5 $g/m^2$ in terms of silver nitrate. If necessary, auxiliary layers such as undercoating layer, intermediate layer, protective layer, and stripping layer are provided in addition to the silver halide emulsion layer. For instance, the negative material used in this invention may have an overcoating layer comprising a water-permeable binder, such as, for example, methylcellulose, sodium salt of carboxymethylcellulose, or sodium alginate (Japanese Patent Publication Nos. 18, 134/63 and 18, 135/63), for the purpose of uniform transfer, said overcoating layer having a small thickness so as not to substantially inhibit or suppress the diffusion.

The silver halide emulsion layer and the image receptive layer of the positive material contain hydrophilic colloidal substances such as gelatin, gelatin derivatives (e.g. phthalated gelatin), cellulose derivatives (e.g. carboxymethylcellulose and hydroxymethylcellulose), and other hydrophilic high-molecular colloidal substances (e.g. dextrin, soluble starch, polyvinyl alcohol, and polystyrenesulfonic acid). The silver halide emulsion comprises silver halides such as, for example, silver chloride, silver bromide, silver chlorobromide and those additionally containing silver iodide, which are dispersed in the above hydrophilic colloids. The silver halide emulsion can be sensitized during its manufacture or before coating. It can be chemically sensitized with sodium thiosulfate, alkylthioureas, gold compounds (e.g. gold rhodanide and gold chloride), or a combination of these compounds in a manner well known to the art. The emulsion is further sensitized to a wave length range of from about 530 to about 560 nm. It can also be panchromatically sensitized. A direct positive silver halide emulsion may also be used.

The silver halide emulsion layer and/or the image receptive layer may contain any of the compounds usually used in carrying out the silver complex diffusion transfer process. Such compounds include antifoggants such as tetrazaindenes and mercaptotetrazoles; coating aids such as saponin and polyethylene oxides; hardeners such as formaldehyde and chrome alum; and plasticizers. Developing agents may also be included.

The supports for use in negative and positive materials are those usually used, which include paper, glass; films such as cellulose acetate film, polyvinylacetal film, polystyrene film, and polyethylene terephthalate film; metal supports clad on both sides with paper; paper supports coated on one or both sides with poly-α-olefins such as polyehtylene.

The positive material may contain physical developing nuclei such as heavy metals and solubilized compounds thereof. One or more layers of the positive material may contain those substances which play an important role in the formation of a diffusion transfer image such as black toners disclosed in Brit. Pat. No. 61,875 and Belg. Pat. No. 502,525 such as 1-phenyl-5-mercaptotetrazole. The positive material may also contain a fixing agent such as sodium thiosulfate in an amount of about 0.1 to about 4 g/m$^2$.

The invention is further illustrated in detail hereunder with reference to Examples, but the invention is not limited thereto.

EXAMPLE 1

[Positive material A]

On one side of a paper support, 110 g/m$^2$, coated on both sides with polyethylene, there was provided, at a coverage of 3 g/m$^2$ on dry basis, an image receptive layer comprising gelatin and a product made from polyvinyl alcohol containing palladium sulfide nuclei and an ethylenemaleic anhydride copolymer to obtain positive material A.

[Positive material B]

Positive material B was prepared by providing, at a coverage of 3 g/m$^2$, an image receptive hardened gelatin layer containing palladium sulfide nuclei on a polyethylene terephthalate film.

[Negative material A]

On the same paper support as that of positive material A, there was provided an undercoating layer containing antihalation carbon black. On said undercoating layer, there was provided an orthochromatically sensitized gelatino silver halide emulsion layer containing 2.3 g/m$^2$ (in terms of silver nitrate) of silver chlorobromide (2 mole-% silver bromide) having an average grain size of 0.3μ, to obtain negative material A.

[Processing solution]

The composition of base developer was as shown below.

| | g |
|---|---|
| Sodium hydroxide | 12 |
| Sodium sulfite, anhydrous | 60 |
| Sodium thiosulfate pentahydrate | 15 |
| Hydroquinone | 12 |
| 1-Phenyl-3-pyrazolidone | 1 |

-continued

| | g |
|---|---|
| Potassium bromide | 1 |
| Tetra-n-butylammonium bromide | 2 |
| 1-Phenyl-5-mercaptotetrazole | 0.05 |
| Made up with water to | 1 liter |

Processing solutions A to J were prepared by adding various amino alcohols to the base developer as shown in Table 1. The amount of amino alcohol was expressed in mole.

TABLE 1

| | | [mole/liter] | | | | | | | | | |
|---|---|---|---|---|---|---|---|---|---|---|---|
| | | Reference | | | | | | This invention | | | |
| | pKa | A | B | C | D | E | F | G | H | I | J |
| N—methyl-ethanolamine | [10.1] | 0.5 | | | | | 0.3 | 0.3 | 0.3 | | |
| N,N—diethyl-ethanolamine | 9.18 | | 0.5 | | | | 0.2 | | | 0.2 | 0.2 |
| 3-Aminopro-panol | [10.16] | | | 0.5 | | | | | | | |
| Diethanol-amine | 8.73 | | | | 0.5 | | | 0.2 | | | 0.3 |
| N—methyldi-ethanolamine | 8.28 | | | | | 0.5 | | | 0.2 | 0.3 | |

Note: The value of pKa in parentheses is the value of pKa [aq.]

Negative material A was mounted in an ordinary process camera, then imagewise exposed, and brought into close contact with positive material A (and B) to transfer the image. The transfer processor employed was OSP-12 (Trade name; a variable conveyance speed type of Mitsubishi Paper Mills Ltd.). The processing temperature was optionally selected. The time of transfer was 60 seconds. The original carried fine lines, 10 to 100μ, at an interval of 10μ and a reflection optical wedge. The magnitude of exposure was controlled by means of wedge. The ability of fine image formation was evaluated from the formed image of fine lines. The photographying was at 70% reduction.

Evaluation of latitude of processing conditions

Tests were carried out at a processing temperature of 10° C., 20° C., and 30° C. The retention time in the processing solution was 3, 6, and 9 seconds. The retention time in the processing solution was varied by controlling the speed of conveyance.

Evaluation of running processing characteristics 10 sets of negative material A and positive material B, both having a size of A-4, were processed with one liter of developer and the residual processing solution was exposed, for 4 days, to the carbon dioxide atmosphere generated from dry ice. After the exposure to carbon dioxide, the processing solution (pH 10.2 at 20° C.) was used in transfer treatement and the characteristics were evaluated.

The latitude of processing conditions in fresh processing solution and the results of evaluation of running processing characteristics were as shown in Tables 2 and 3, respectively.

TABLE 2

| Temp. of processing soln. | 10° C. | 10° C. | 20° C. | 30° C. | 30° C. | 10° C. | 20° C. | 30° C. | Remarks |
|---|---|---|---|---|---|---|---|---|---|
| Processing speed (retention time in soln.) | 3 sec. | | 6 sec. | | 9 sec. | | 6 sec. | | |
| Positive material | A | | B | | A | | A | | Characteristics |

TABLE 2-continued

| Item of characteristics | | Staining | Transmission density | | | Fine image forming ability (μ) | | Relative sensitivity, camera exposure | | Overall evaluation |
|---|---|---|---|---|---|---|---|---|---|---|
| | | | | | | | | | | of fresh soln. |
| Processing solution | A | o | 3.8 | 4.2 | 3.3 | 40 | 90 | 100 | 130 | Poor high temp. characteristics |
| | B | o | 2.8 | 4.0 | 3.0 | 45 | 85 | 100 | 135 | Poor high temp. characteristics |
| | C | o | 3.5 | 2.8 | 2.0 | 70 | 100 | 120 | 160 | Poor high temp. characteristics |
| | D | Δ | 3.0 | 4.5 | 4.0 | 30 | 75 | 100 | 110 | Poor low temp. characteristics |
| | E | Δ | 3.3 | 4.3 | 4.6 | 25 | 70 | 100 | 110 | Poor low temp. characteristics |
| | F | o | 3.4 | 4.0 | 3.0 | 45 | 90 | 100 | 120 | Good |
| | G | o | 3.8 | 4.3 | 3.8 | 30 | 90 | 100 | 110 | " |
| | H | o | 3.8 | 4.6 | 4.3 | 25 | 90 | 100 | 110 | " |
| | I | o | 3.8 | 4.2 | 3.2 | 25 | 90 | 100 | 110 | " |
| | J | o | 3.6 | 4.3 | 3.6 | 30 | 90 | 100 | 110 | " |

o: Substantially no stain
Δ: Some stains

TABLE 3

| Characteristics of running solution | | | | | | | | | |
|---|---|---|---|---|---|---|---|---|---|
| Temp. of processing soln. | | 20° C. | | | 20° C. | | 20° C. | 20° C. | Remarks |
| Processing speed (retention time in processing soln.) | | 6 sec. | | 3 sec. | 6 sec. | 9 sec. | 6 sec. | 6 sec. | Running characteristics |
| Positive material | | A | | | A | | A | B | |
| Item of characteristics | | Tone, wedge characteristics | Rel. sensitivity, camera exposure | Staining | | | Halftone color | Transmission density | Overall evaluation |
| Processing solution | A | Soft | 70 | x | x | o | Brown | 2.4 | Poor |
| | B | " | 65 | x | x | Δ | " | 2.2 | " |
| | C | " | 75 | x | x | x | Redish brown | 2.0 | " |
| | D | " | 80 | | Δ | o | Purple | 2.6 | " |
| | E | " | 85 | Δ | Δ | o | " | 2.8 | " |
| | F | " | 70 | x | x | o | Brown | 2.6 | " |
| | G | Hard | 90 | Δ | o | o | Cold black | 3.2 | Fair (good) |
| | H | " | 90 | o | o | o | Cold black | 3.6 | Fair (good) |
| | I | " | 90 | Δ | o | o | Cold black | 3.4 | Fair (good) |
| | J | " | 90 | Δ | o | o | Warm black | 3.0 | Fair (good) |

o: Substantially no stain
x: Conspicuous stain
: Considerable stain
Δ: Some stain
Δ : A little stain Processing solutions G to J according to this invention showed advantages of high image density, good stability against the change in processing temperature, no staining in low temperature processing, good halftone color, small temperature dependency of practical printing sensitivity, and diserable ability for fine image formation.

As is apparent from the comparison of reference processing solution F with the present processing solution G, H, I or J, it is understood that a processing solution containing a combination of two amino alcohols having different pKa values but both above 9 does not give good results.

EXAMPLE 2

[Negative material B]

Negative material B was prepared in the same manner as that of preparing negative material A of Example 1, except that the undercoating layer contained hydroquinone and phenidone.

[Processing solution]

Processing solutions M to X were prepared by adding various amino alcohols, shown in Table 4, to a base processing solution of the following composition:

| | |
|---|---|
| Trisodium phosphate, dodecahydrate | 50 g |
| Sodium sulfite, anhydrous | 40 |
| Potassium hydroxide | 5 |
| Sodium thiosulfate, pentahydrate | 20 |
| Potassium bromide | 1 |
| Benzotriazole | 0.1 |
| 1-Phenyl-5-mercaptotetrazole | 0.07 |
| Made up with water to | 1 liter |

TABLE 4

| | [ml/liter] | | | | | | | | | | | |
|---|---|---|---|---|---|---|---|---|---|---|---|---|
| | Reference | | | | | | This invention | | | | | |
| | M | N | O | P | Q | R | S | T | U | V | W | X |
| N—methylethanolamine | 0.4 | | | | | | 0.2 | 0.2 | 0.2 | 0.2 | | |
| N,N—diethylethanolamine | | 0.4 | | | | | | | | | 0.2 | 0.2 |
| N—methyldiethanolamine | | | 0.4 | | | | 0.2 | | | | 0.2 | |
| Diethanolamine | | | | 0.4 | | | | 0.2 | | | | |
| Triethanolamine | | | | | 0.4 | | | | 0.2 | | | |
| N—ethyl-2,2' iminodiethanolamine | | | | | | 0.4 | | | | 0.2 | | 0.2 |

The running characteristics were evaluated by using One-Step S-III Processor (Trade name for Mitsubishi Paper Mills Ltd.), daily processing 15 sets of negative material B and positive material A until the processing solution became no longer usable, and recording the number of processed sets and number of elapsed days. The processing characteristics of fresh processing solution and the running characteristics were as shown in Table 5. As is seen from Table 5, the processing solutions of this invention showed excellent characteristics.

TABLE 5

| | Processing characteristics of fresh solution*1 | | | | | |
|---|---|---|---|---|---|---|
| Temp. of solution | 10° C. | 30° C. | 20° C. | | | |
| Positive material | A | B | A | Running characteristics Processing limit | | |
| | Ground staining | Transmission density | Wedge characteristics | Number of processed sets | Number of days of processing | Marginal characteristics*2 |
| M | Δ | 3.3 | o | 60 | 4 | Y |
| N | Δ | 2.8 | o | 45 | 3 | Y |
| O | Δ | 3.8 | o | 45 | 3 | L |
| P | Δ | 3.6 | o | 45 | 3 | L |
| Q | x | 3.4 | o | 45 | 3 | S |
| R | Δ | 3.8 | o | 45 | 3 | L |
| S | o | 3.8 | o | 150 | 10 | L |
| T | Δ | 3.6 | o | 120 | 8 | Y |
| U | Δ | 4.2 | o | 105 | 7 | L |
| V | o | 4.2 | o | 150 | 10 | L |
| W | o | 3.6 | o | 105 | 7 | Y |
| X | o | 3.7 | o | 105 | 7 | Y |

Note:
*1One-Step S-III Processor was used. Room temp. 23° C.
*2Marginal characteristics:
Y: Yellow staining of the ground of positive material.
L: Poor density of fine lines.
S: Soft tone due to desensitization.
Marks o, Δ , Δ and x have the same meanings as hereinbefore.

EXAMPLE 3

On each one side of a paper support, 110 g/m$^2$ in weight, coated on both sides with polyethylene and a hydrophilized polyester support, 100μ in thickness, there was provided an image receptive layer comprising a mixture (4:1) of gelatin containing nickel sulfide nuclei and carboxymethylcellulose, the coverage of hydrophilic colloid being 3 g/m$^2$ on dry basis, to obtain positive materials for reflection and for transmission, respectively.

On the same paper support as used in the positive material, there was provided a gelatin undercoating layer (3.5 g/m$^2$ of gelatin) comprising antihalation carbon black, 1 g/m$^2$ of hydroquinone, and 0.3 g/m$^2$ of 1-phenyl-4-methyl-3-pyrazolidone and overcoated with an orthochromatically sensitized gelatino (1.5 g/m$^2$) silver halide emulsion layer comprising 1.5 g/m$^2$ (in terms of silver nitrate) of silver chlorobromide (3 mole-% of silver bromide) having an average grain size of 0.3μ, and 0.2 g/m$^2$ of hydroquinone, to obtain a negative material.

Processing solutions A' to G' were prepared by adding various amino alcohols, shown in Table 6, to a base processing solution of the following composition:

| | |
|---|---|
| EDTA | 1 g |
| Trisodium phosphate, dodecahydrate | — |
| Sodium sulfite | 60 |
| Sodium thiosulfate, pentahydrate | 20 |
| Potassium bromide | 1 |
| 1-Phenyl-5-mercaptotetrazole | 0.05 |
| Made up with water to | 1 liter |

TABLE 6

| | [mole/liter] | | | | | | | |
|---|---|---|---|---|---|---|---|---|
| | pKa | A' | B' | C' | D' | E' | F' | G' |
| N—methylethanolamine | [10.1] | 0.6 | — | 0.3 | — | — | 0.3 | 0.3 |
| N,N—diethylethanolamine | 9.18 | — | 0.6 | 0.3 | — | — | — | — |
| N—methyldiethanolamine | 8.28 | — | — | — | 0.6 | — | —.3 | — |
| Diethanolamine | 8.73 | — | — | — | — | 0.6 | — | 0.3 |

Note: The value of pKa in parentheses is the value of pKa [aq.].

The negative material was mounted in an ordinary process camera, then imagewise exposed, and brought into close contact with the positive material in an ordinary processor to transfer the image, the time of transfer being 60 seconds. The original used in the above exposure carried fine lines, 10 to 100μ, at an interval of 10μ and a reflection optical wedge. The magnitude of exposure was controlled by means of a wedge. The ability of fine image formation was evaluated from the formed image of fine lines. The relative sensitivity in the exposure in camera was calculated by assuming the sensitivity obtained by use of processing solution A' at 25° C. to be 100.

Evaluation of latitude of processing conditions

Characteristics shown in Table 7 were evaluated at processing temperatures of 15° C. and 25° C. The reflection density was measured on the image formed on the positive material having a polyethylene-coated paper support, while the transmission density was measured on the silver image formed on the positive material having a polyester film support.

Evaluation of running characteristics

After the processing of 30 sets of negative and positive materials, A-4 in size, with 1 liter of the developer, the residual solution was exposed to the atmosphere for 10 days and again used in transfer processing. The residual solution was evaluated for the characteristics. The processing solution had lost 30% of initial weight due to evaporation. The results of evaluation at 20° C. for running characteristics were as shown in Table 8. The results shown in Tables 7 and 8 were obtained by conyrolling the speed of conveyance so that the retention time of the negative material may become 6 seconds.

TABLE 7

| Processing solution | Characteristics: Density reflec./transm. | | Yellow staining of the ground of pos. material | | Rel. sensitivity in camera exposure | | Ability for formation of fine image (μ) | |
|---|---|---|---|---|---|---|---|---|
| | Temp. 15° C. | 25° C. | 15° C. | 25° C. | 15° C. | 25° C. | 15° C. | 25° C. |
| A' | 1.50/2.8 | 1.57/2.2 | Δ | o | 100 | 105 | 30 | 35 |
| B' | 1.55/2.3 | 1.60/2.0 | Δ | o | 100 | 105 | 30 | 35 |
| C' | 1.55/2.5 | 1.58/2.0 | Δ | o | 100 | 105 | 30 | 35 |
| D' | 1.60/3.2 | 1.65/2.8 | o | o | 95 | 100 | 20 | 25 |
| E' | 1.55/3.0 | 1.60/2.8 | o | o | 90 | 95 | 20 | 25 |
| F' | 1.58/3.2 | 1.65/3.0 | o | o | 100 | 105 | 20 | 25 |
| G' | 1.55/3.0 | 1.60/3.0 | o | o | 100 | 105 | 20 | 25 |

o, Δ and Δ have the same meanings as hereinbefore.

TABLE 8

| Processing solution | Running characteristics (20° C.) Characteristics: Uniformity of solid black area | Tone | Halftone color | Rel. sensitivity in camera exposure | Yellow staining of ground of pos. material | Separability between neg. and pos. materials | Quality of fine line image |
|---|---|---|---|---|---|---|---|
| A' | Poor | Soft | x (Bad) | 65 | xx | Δ | Poor |
| B' | " | " | x " | 65 | xx | Δ | " |
| C' | " | " | x " | 65 | xx | Δ | " |
| D' | Δ Good | Hard | Δ (Fairly good) | 80 | o | o | Good |
| E' | Δ " | " | o (good) | 75 | Δ | o | " |
| F' | o " | " | o " | 95 | o | o | " |
| G' | o " | " | o " | 95 | o | o | " |

xx: Conspicuous stain
Δ : A little stain
o: No stain

Processing solutions F' and G' according to this invention showed advantages of high image density, good stability against the change in processing temperature, no staining in low temperature processing, good halftone color, little temperature dependency of practical printing sensitivity (expressed in relative sensitivity assuming the sensitivity at a processing temperature of 25° C. to be 100), desirable ability for fine image formation, and formation of good line image even in running processing.

In a similar experiment on the relation between processing temperature and conveyance speed, it was confirmed that under the conditions of low processing temperature and high speed conveyance the tendency of yellow staining of the background was low and the deterioration in the ability for the formation of fine image was very little under the conditions of high processing temperature and low conveyance speed.

EXAMPLE 4

The following processing solutions having varied trisodium phosphate content were prepared:

| | 1 | 2 | 3 | 4 |
|---|---|---|---|---|
| EDTA | 1 (g) | 1 (g) | 1 (g) | 1 (g) |
| Hydroxyethylcellulose | 2 | 2 | 2 | 2 |
| Trisodium phosphate dodecahydrate | 0 | 25 | 50 | 75 |
| Sodium sulfite, anhydrous | 50 | 50 | 50 | 50 |
| Sodium thiosulfate pentahydrate | 15 | 15 | 15 | 15 |
| Potassium iodide | 0.05 | 0.05 | 0.05 | 0.05 |
| 1-Phenyl-5-mercapto-tetrazole | 0.05 | 0.05 | 0.05 | 0.05 |
| 5-Methylbenzotriazole | 0.1 | 0.1 | 0.1 | 0.1 |
| N—methylethanolamine | 40 | 40 | 40 | 40 |
| N—methyldiethanolamine | 40 | 40 | 40 | 40 |
| Made up with water to | | | 1 liter | |

In a manner similar to that in Example 3, after having processed 30 sets of negative and positive materials with 1 liter of each processing solution at 20° C., each solution was exposed to the atmosphere and the change in characteristics with time was examined (density, uniformity, sensitivity, staining, etc. with respect to transferred image) to determine the time period allowable for the processing solution to retain acceptable processing ability. The results were as shown in Table 9.

TABLE 9

| Processing solution | Duration of sustained processing ability |
|---|---|
| 1 | ≧300 |
| 2 | ≧300 |
| 3 | about 150 |
| 4 | about 100 |

Processing solutions 1 and 2 showed very good characteristics.

EXAMPLE 5

Processing solutions 5 to 11 were prepared using amino alcohols shown in the following table and in a manner similar to that of preparing processing solution 1 of Example 4 and tested similarly to Example 3 to obtain the results as good as those of Example 3.

| | [mol/l] | | | | | | |
|---|---|---|---|---|---|---|---|
| | 5 | 6 | 7 | 8 | 9 | 10 | 11 |
| N—methylamino-ethanol | 0.4 | 0.4 | 0.4 | 0.4 | 0.4 | 0.4 | 0.4 |
| Diethanolamine | 0.2 | 0.4 | — | — | — | — | 0.4 |
| Triethanolamine | — | — | 0.3 | 0.6 | — | — | 0.3 |
| N—ethyl-2,2'-iminodiethanol | — | — | — | — | 0.3 | 0.6 | — |

EXAMPLE 6

[Negative material M]

On the same paper support as that of positive material A, there was provided an under coating layer containing antihalation carbon black, and overcoated with an orthochromatically sensitized gelatino silver halide emulsion layer containing 2.0 g/m$^2$ (in terms of silver nitrate) of silver chlorobromide (5 mole-% silver bromide) having an average grain size of 0.3$\mu$, to obtain negative material M.

[Negative material N]

Negative material N for use as direct positive was prepared similarly to negative material M, except that the reference emulsion B described in Example 1 of Japanese Patent Application "Kokai" (Laid-open) No. 96,331/82 was used.

Negative materials M and N were mounted in an ordinary process camera, then imagewise exposed, and brought into close contact with positive materials A and B, respectively, to effect image transfer. Tests were carried out similarly to Example 1. The composition of the processing solution, processing characteristics of the fresh processing solution, and running processing characteristics were as shown in Tables 10, 11 and 12, respectively.

TABLE 10

| Base composition: | |
|---|---|
| Sodium hydroxide | X g |
| Sodium sulfite, anhydrous | 60 g |
| Sodium thiosulfate pentahydrate | 20 g |
| Hydroquinone | 12 g |
| 1-Phenyl-3-pyrazolidone | 1 g |

TABLE 10-continued

| | |
|---|---|
| Potassium iodide | 0.05 g |
| Potassium bromide | 0.5 g |
| 1-Phenyl-5-mercaptotetrazole | 0.05 g |
| N—methylethanolamine | Y mole |
| Diethanolamine | Z mole |
| Made up with water to | 1 liter |

| Processing solution | a | b | c | d | e | f |
|---|---|---|---|---|---|---|
| X | 6 | 6 | 6 | 0 | 0 | 0 |
| Y | 0.6 | 0 | 0.3 | 0.6 | 0 | 0.3 |
| Z | 0 | 0.6 | 0.3 | 0 | 0.6 | 0.3 |

TABLE 11

| | Neg. | Pos. | a | b | c | d | e | f |
|---|---|---|---|---|---|---|---|---|
| Transmission density | | | | | | | | |
| 10° C. | M | B | 3.9 | 2.8 | 3.9 | 4.2 | 3.3 | 4.1 |
| 20° C. | " | " | 4.2 | 3.6 | 4.1 | 4.5 | 3.9 | 4.3 |
| 30° C. | " | " | 4.0 | 3.5 | 3.8 | 4.5 | 4.1 | 4.3 |
| 20° C. | N | " | 3.5 | 3.0 | 3.4 | 3.4 | 3.1 | 3.2 |
| Yellow staining (positive) | | | | | | | | |
| 10° C. | M | A | o | Δ | o | o | Δ | o |
| 10° C. | N | A | o | x | o | o | x | o |
| Reflection density | | | | | | | | |
| 20° C. | M | A | 1.60 | 1.57 | 1.64 | 1.61 | 1.58 | 1.63 |
| Fine image formation ($\mu$) | | | | | | | | |
| 20° C. | M | A | 45 | 20 | 25 | 40 | 25 | 25 |

o, Δ and x have the same meanings as hereinbefore.

TABLE 12

| | Processing characteristics of running solution | | | | | | | |
|---|---|---|---|---|---|---|---|---|
| | Neg. | Pos. | a | b | c | d | e | f |
| Transmission density | | | | | | | | |
| 20° C. | M | B | 3.4 | 3.1 | 3.8 | 3.9 | 3.4 | 4.1 |
| 20° C. | N | " | 2.9 | 2.5 | 3.1 | 3.0 | 2.8 | 3.1 |
| Yellow staining (positive) | | | | | | | | |
| 10° C. | M | A | Δ | x | o | Δ | Δ | o |
| 10° C. | N | A | Δ | x | o | Δ | x | o |
| Reflection density | | | | | | | | |
| 20° C. | M | A | 1.58 | 1.55 | 1.61 | 1.58 | 1.55 | 1.60 |

o, Δ and x have the same meanings as hereinbefore.

Processing solutions c and b of this invention exhibited advantages of high transmission density and, in addition, good stability to the change in processing temperature, little staining in low temperature processing, desirable halftone color, little temperature dependence of print sensitivity (expressed in relative sensitivity by assuming the sensitivity at a processing temperature of 20° C. to be 100), and excellent ability to form fine images.

It was confirmed in another experiment conducted to examine the relation between processing solution temperature and conveying speed that the processing solution of this invention has little tendency to cause staining of the background under the conditions of low temperature and high conveying speed, while under the conditions of high temperature and low conveying speed, there occurs very little deterioration in the ability to form fine images. It is also seen that the processing solution of this invention is excellent also in the running solution characteristics.

EXAMPLE 7

This Example presents a method of running processing with a replenisher.

The following processing solution was prepared:

| | |
|---|---|
| Sodium sulfite, anhydrous | 50 g |
| Sodium thiosulfate pentahydrate | 18 |
| Potassium bromide | 1 |
| 1-Phenyl-5-mercaptotetrazole | 0.1 |
| N—methylethanolamine | 0.4 mole |
| N—methyldiethanolamine | 0.3 mole |
| Made up with water to | 1 liter |

The negative and positive materials employed were those prepared in Example 3.

One liter of the processing solution was charged into a commercial processor (One-Step S-III Processor, trade name for Mitsubishi Paper Mills Ltd.) and 30 sets of negative and positive materials, both A-4 in size, were processed. The quantity of processing solution carried away by one set of negative and positive materials was about 3 ml. The negative material was exposed to a continuous tone original through a contact screen of 133 lines/inch in an ordinary process camera. The temperature of processing solution was 20° C. After a transfer time of 60 seconds, both materials were pulled apart.

Running processing test

After the operation, the cover of the processor was removed and the residual processing solution, about 900 ml in volume, was left standing as such for 7 days, during which the residual solution had decreased to 680 ml. The residual solution was replenished by making up with 320 ml of the fresh processing solution to about 1 liter, then 30 sets of negative and positive materials were processed, and the last set was tested for the characteristics. The above procedure was repeated every 7 days for one month. The results of evaluation for maximum reflection density, appearance of dots, separability, yellow staining, and uniformity of transfer were as shown in Table 13, wherein the marks of rating have following meanings:

o: Good

Δ: Poor x: Very poor.

TABLE 13

| | Fresh solution | After 7 days | After 14 days | After 21 days | After 28 days |
|---|---|---|---|---|---|
| Reflection density | 1.63 | 1.64 | 1.63 | 1.62 | 1.62 |
| Dots | o | o | o | o | o |
| Separability | o | o | o | o | o |
| Yellow staining | o | o | o | o | o |
| Uniformity of transfer | o | o | o | o | o |

The results shown in Table 13 indicate that the processing system utilizing the processing solution of this invention as the replenisher permits long-term running processing without causing appreciable change in characteristics. The replenishing can be performed by the method of surface replenishing.

COMPARATIVE EXAMPLE

The procedure of Example 7 was repeated, except that the following processing solution and replenisher was used. The results obtained were as shown in Table 14.

| | |
|---|---|
| Trisodium phosphate dodecahydrate | 70 g |

-continued

| | |
|---|---|
| Sodium sulfite, anhydrous | 50 g |
| Sodium thiosulfate pentahydrate | 18 g |
| Potassium bromide | 1 g |
| 1-Phenyl-5-mercaptotetrazole | 0.05 g |
| N—methylethanolamine | 0.4 mole |
| Made up with water to | 1 liter |

TABLE 14

| | Fresh solution | After 7 days | After 14 days | After 21 day | After 28 days |
|---|---|---|---|---|---|
| Reflection density | 1.61 | 1.59 | 1.54 | 1.46 | 1.35 |
| Dots | o | o | Δ | Δ | x |
| Separability | o | o | o | o | Δ |
| Yellow staining | o | o | o | Δ | x |
| Uniformity of transfer | o | o | o | Δ | Δ |

EXAMPLE 8

The procedure of Example 7 was repeated, except that the processing solution as well as replenisher of the following composition was used. Results similar to those of Example 7 were obtained.

| | |
|---|---|
| Trisodium phosphate dodecahydrate | 35 g |
| Sodium sulfite, anhydrous | 50 g |
| Sodium thiosulfate pentahydrate | 15 g |
| 1-Phenyl-5-mercaptotetrazole | 0.1 g |
| Potassium iodide | 0.1 g |
| N,N—diethylethanolamine | 0.4 mole |
| Diethanolamine | 0.2 mole |
| Triethanolamine | 0.2 mole |
| Made up with water to | 1 liter |

EXAMPLE 9

Procedure of Example 7 was repeated, except that a solution of the following composition was used as processing solution as well as replenisher. Results similar to those of Example 7 were obtained.

| | |
|---|---|
| Sodium sulfite, anhydrous | 40 g |
| Sodium thiosulfate pentahydrate | 15 g |
| 1-Phenyl-5-mercaptotetrazole | 0.07 g |
| Benzotriazole | 0.14 g |
| N—ethylethanolamine | 0.3 mole |
| N—ethyldiethanolamine | 0.5 mole |
| Made up with water to | 1 liter |

EXAMPLE 10

The siliver halide photosensitive material for direct positive described in Example 4 of Japanese Patent Application "Kokai" (Laid=open) No. 45,441/84 was used as negative material. The positive material was prepared by providing an image receptive gelatin layer (3 g/m$^2$) containing palladium sulfide nuclei on polyester film. The procedure of Example 7 was followed, except that a solution of the following composition was used as processing solution and as replenisher.

| | |
|---|---|
| Sodium hydroxide | 5 g |
| Sodium sulfite, anhydrous | 60 g |
| Sodium thiosulfate pentahydrate | 20 g |
| Hydroquinone | 15 g |
| 1-Phenyl-3-pyrazolidone | 1.5 g |
| 1-Phenyl-5-mercaptotetrazole | 0.1 g |
| Potassium iodide | 0.05 g |

-continued

| | |
|---|---|
| N—methylethanolamine | 0.5 mole |
| N—methyldiethanolamine | 0.3 mole |
| Triethanolamine | 0.2 mole |
| Made up with water to | 1 liter |

Characteristics of the processing solution of this invention were retained without substantial change, the transmission density being 3.8 and the dot quality being excellent.

EXAMPLE 11

A processing solution of the following composition was prepared.

| | [J] | [K] |
|---|---|---|
| Trisodium phosphate dodecahydrate | 60 | 20 g |
| Sodium sulfite, anhydrous | 40 | 20 g |
| Sodium thiosulfate pentahydrate | 20 | 20 g |
| 1-Phenyl-5-mercaptotetrazole | 0.1 | 20 g |
| Benzotriazole | 0.2 | 20 g |
| N—methylethanolamine | 0.4 | 0.4 mole |
| N—methyldiethanolamine | — | 0.1 mole |
| Triethanolamine | — | 0.1 mole |
| Carboxymethylcellulose | 5 | 5 g |
| Made up with water to | | 1 liter |
| Viscosity, cps at 20° C. | 7.1 | 7.3 |

Note:
Carboxymethylcellulose was "Celogen PR"of Dai-ichi Kogyo Seiyaku Co.

Thirty sets of the same negative and positive materials as used in Example 3 were processed (the amount of processing solution which was carried away was about 30 ml/30 sets). After having been left standing for one month, the residual solution had decreased to about 600 ml. The exhausted residual solution was replenished with 400 ml of the fresh processing solution to restore the volume to about 1 liter. Thirty sets of negative and positive materials were processed. The procedure was repeated every one month. The results were as shown in Table 15.

TABLE 15

| | [J] | | | | [K] | | | |
|---|---|---|---|---|---|---|---|---|
| | Fresh solution | After 1 month | After 2 month | After 3 month | Fresh solution | After 1 month | After 2 month | After 3 month |
| Reflection density | 1.58 | 1.45 | 1.24 | 1.07 | 1.62 | 1.60 | 1.61 | 1.63 |
| Dot | o | Δ | x | x | o | o | o | o |
| Separability | o | Δ | Δ | x | o | o | o | o |
| Uniformity of transfer | o | x | x | x | o | o | o | o |
| Yellow staining | o | o | Δ | x | o | o | o | o |
| CMC precipitation | o | Δ | Δ | x | o | o | o | o |

As compared with the case wherein the reference processing solution [J] was used, the superiority of [K] is apparent.

EXAMPLE 12

The procedure of Example 11 was repeated using the undermentioned solution as processing solution and as replenisher. It was also excellent in running processing characteristics.

| | |
|---|---|
| Sodium sulfite, anhydrous | 50 g |
| Potassium sulfite, anhydrous | 5 g |
| Sodium thiosulfate pentahydrate | 15 g |

-continued

| | |
|---|---|
| 1-Phenyl-5-mercaptotetrazole | 0.05 g |
| Benzotriazole | 0.15 g |
| Diethanolamine | 0.5 mole |
| N,N—diethylethanolamine | 0.5 mole |
| Pullulan (av. mol. wt. $30 \times 10^4$) | 10 g |
| Made up with water to | 1 liter |
| Viscosity at 20° C., cps | 3.5 |

EXAMPLE 13

A process solution (stock solution) of the following composition was prepared:

| | |
|---|---|
| Sodium sulfite, anhydrous | 45 g |
| Sodium thiosulfate pentahydrate | 16 g |
| Hydroxyethylcellulose | 3 g |
| Potassium bromide | 1 g |
| 1-Phenyl-5-mercaptotetrazole | 0.1 g |
| N—methylethanolamine | 0.6 mole |
| N—methyldiethanolamine | 0.3 mole |
| Made up with water to | 1 liter |

Sixty sets of the same negative and positive materials as used in Example 3 were processed (amount of processing solution carried away: about 200 ml/60 sets). The residual processing solution was left standing for 5 days under the environmental conditions of 26° C. and 40% RH; meanwhile about 200 ml of water was lost by evaporation. To the exhausted solution was added 400 ml of the replenisher prepared by diluting the stock solution with equal volume of water. Sixty sets of negative and positive materials were processed with the replenished solution. The above procedure was repeated every 5 days for 2 months. The results of test were as shown in Table 16.

TABLE 16

| | Fresh solution | After 15 days | After 30 days | After 45 days | After 60 days |
|---|---|---|---|---|---|
| Reflection density | 1.66 | 1.66 | 1.68 | 1.67 | 1.68 |
| Dot | o | o | o | o | o |
| Separability | o | o | o | o | o |
| Uniformity of transfer | o | o | o | o | o |
| Yellow staining | o | o | o | o | o |

The results shown in Table 16 indicate that according to the method of this invention it is possible to maintain steadily desirable characteristics for a period of time far longer than 2 months, none of the characteristics exhibiting any significant difference between the initial value and the value obtained after 60 sets of photographic materials have been processed.

EXAMPLE 14

The procedure of Example 13 was repeated, except that after 30 sets of negative and positive materials had been processed, the processing solution was replenished with 300 ml of a replenisher prepared by diluting the stock solution with thrice the volume of water. The results obtained were substantially the same as those obtained in Example 13.

EXAMPLE 15

The procedure of Example 13 was followed, except that the negative and the positive materials described in Example 10 were used and the processing solution of the following composition was used.

| | |
|---|---|
| Sodium hydroxide | 5 g |
| Sodium sulfite, anhydrous | 60 g |
| Sodium thiosulfate pentahydrate | 20 g |
| Hydroquinone | 12 g |
| 1-Phenyl-3-pyrazolidone | 1 g |
| 1-Phenyl-5-mercaptotetrazole | 0.1 g |
| Potassium iodide | 0.1 g |
| Hydroxyethylcellulose | 2 g |
| N,N—diethylethanolamine | 0.3 mole |
| N—ethyldiethanolamine | 0.3 mole |
| Made up with water to | 1 liter |

Running processing gave a transmission density of 3 or above, good dot quality, and good separability.

EXAMPLE 16

The procedure of Example 14 was repeated, except that the following replenisher was used;

| | |
|---|---|
| Sodium sulfite, anhydrous | 15 g |
| Sodium thiosulfate pentahydrate | 5 g |
| N—methylethanolamine | 0.2 mole |
| N—methyldiethanolamine | 0.1 mole |
| Made up with water to | 1 liter |

The results obtained were substantially the same as those obtained in Example 14.

EXAMPLE 17

The running processing described in Example 7 was repeated except that a processing solution of the undermentioned composition was used and after the running processing had begun, the exhausted processing solution was replenished every 10 days with 200 ml of water, the exposure to the atmosphere was carried out under the conditions of 23° C. and 65% RH. The results of evaluation were as shown in Table 17.

| | |
|---|---|
| Sodium sulfite, anhydrous | 45 g |
| Sodium thiosulfate pentahydrate | 16 g |
| Hydroxyethylcellulose | 3 g |
| Potassium bromide | 1 g |
| 1-Phenyl-5-mercaptotetrazole | 0.05 g |
| N—methylethanolamine | 0.4 mole |
| N—methyldiethanolamine | 0.4 mole |
| Made up with water to | 1 liter |

TABLE 17

| | Fresh solution | After 10 days | After 20 days | After 30 days | After 40 days |
|---|---|---|---|---|---|
| Reflection density | 1.66 | 1.65 | 1.66 | 1.64 | 1.63 |
| Dot | o | o | o | o | o |
| Separability | o | o | o | o | o |
| Uniformity of transfer | o | o | o | o | o |

What is claimed is:

1. An aqueous processing solution for silver complex diffusion transfer process which contains at least one amino-alcohol having a pKa value of less than 9 and at least one amino alcohol having a pKa value of 9 or more, said pKa values being as determined in a 50 wt % aqueous ethanol solution at 25° C.

2. A processing solution according to claim 1 wherein the amino alchols are both represented by the following general formula:

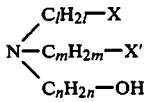

wherein X and X' represent hydrogen atom, hydroxyl group or amino group, 1 and m represent 0 or integers of 1 or more and n represents an integer of 1 or more.

3. A processing solution according to claim 1 wherein the amino alcohols are both secondary or tertiary amines having at least one hydroxyalkyl group.

4. A processing solution according to claim 3 wherein one of the amino alcohols has one hydroxyalkyl group and another has two or more hydroxyalkyl groups.

5. A processing solution according to claim 1 wherein the difference in pKa value between the two amino alcohols is 0.3 or more.

6. A processing solution according to claim 1 wherein the total amount of the amino alcohols is 0.25–2 mols/l.

7. A processing solution according to claim 6 wherein the total amount of the amino alcohols is 0.4–1.5 mol/l.

8. A processing solution according to claim 1 wherein the molar ratio of the amino alcohol having the pKa value of less than 9 and the amino alcohol having the pKa value of 9 or more is 2:8–8:2.

9. A processing solution according to claim 1 which additionally contains a thiosulfate.

10. A processing solution according to claim 1 which additionally contains a sulfite.

11. A processing solution according to claim 1 which contains a water-soluble polymer in an amount to impart to the solution a viscosity of 3–20 cps at 20° C.

12. A processing solution according to claim 1 which contains substantially no developing agent and contains about 0.1 mol/l of $M_3PO_4$ wherein M represents an alkali metal.

13. A processing solution according to claim 12 wherein amount of $M_3PO_4$ is 0–0.07 mol/l.

14. A processing solution according to claim 1 which contains p-dihydroxybenzene as a developing agent and about 0.2 mol/l of MOH wherein M is an alkali metal.

15. A silver complex diffusion transfer process which comprises imagewise exposing a silver halide emulsion layer and developing it with the processing solution of claim 1 in the presence of a developing agent and a solvent for silver halide to transfer the thus produced imagewise silver complex to an image receiving material.

16. A silver complex diffusion transfer process according to claim 15 which uses a silver halide photosensitive material and an image receiving material.

17. A silver complex, diffusion transfer process according to claim 15 which uses a replenisher containing an amino alcohol having a pKa value of 9 or more.

18. A silver complex diffusion transfer process according to claim 17 wherein the replenisher has substantially the same composition as that used in claim 5 in undiluted form.

19. A silver complex diffusion transfer process according to claim 18 wherein the replenisher is diluted with water.

20. A silver complex diffusion transfer process according to claim 15 which uses the processing solution of claim 12.

21. A silver complex diffusion transfer process according to claim 15 which uses the processing solution of claim 14.

22. A silver complex diffusion transfer process according to claim 18 which uses as the processing solution and the replenisher alkaline solutions containing (a) 0–0.13 mol of $M_3PO_4$ wherein M is an alkali metal, (b) at least 0.5 mol of an amino alcohol and (c) a water-soluble polymer in an amount to impart to the solution a viscosity of 3–20 cps at 20° C.

23. A silver complex diffusion transfer process according to claim 15 which uses water as the replenisher.

* * * * *